US005771730A

United States Patent [19]

Huet

[11] Patent Number: 5,771,730

[45] Date of Patent: Jun. 30, 1998

[54] EQUIPMENT FOR FORMING METAL PROFILES

[75] Inventor: Jean-Paul Huet, Nantes, France

[73] Assignee: GEC Alsthom ACB, Paris, France

[21] Appl. No.: 921,037

[22] Filed: Aug. 29, 1997

[30] Foreign Application Priority Data

Aug. 30, 1996 [FR] France ..... 96 10620

[51] Int. Cl.[6] ..... B21D 11/02

[52] U.S. Cl. ..... 72/58; 72/296; 72/297; 72/370

[58] Field of Search ..... 72/58, 57, 296, 72/297, 369, 370, 302

[56] References Cited

U.S. PATENT DOCUMENTS

| | | | |
|---|---|---|---|
| 2,739,634 | 3/1956 | Gray et al. | 72/296 |
| 3,396,565 | 8/1968 | Miller | 72/297 |
| 4,704,886 | 11/1987 | Evert et al. | 72/57 |
| 4,803,878 | 2/1989 | Moroney | 72/296 |
| 4,815,308 | 3/1989 | Moroney | 72/57 |
| 4,827,753 | 5/1989 | Moroney | 72/296 |
| 5,396,786 | 3/1995 | Bartholomew et al. . | |

FOREIGN PATENT DOCUMENTS

| | | | |
|---|---|---|---|
| 0414545 | 2/1991 | European Pat. Off. . | |
| 0588528A1 | 3/1994 | European Pat. Off. . | |
| 04129789 | 12/1994 | Germany . | |
| 6-47453 | 2/1994 | Japan | 72/296 |

*Primary Examiner*—David Jones

*Attorney, Agent, or Firm*—Sughrue, Mion, Zinn, Macpeak & Seas, PLLC

[57] ABSTRACT

The equipment forms metal profiles on a stretch-bending machine on which a profile to be formed is held at its end by jaws connected to stretching rams and to a system for bending it against a convex punch member fixed to a toolholder table of the machine. The equipment includes a die member which is pressed against the punch member, once the profile has been bent against the punch member. An elastic material mandrel is placed inside the profile and the mandrel is compressed-expanded so that it presses the profile against internal surfaces of the punch member and of the die member when closed one against the other.

4 Claims, 5 Drawing Sheets

EQUIPMENT FOR FORMING METAL PROFILES

BACKGROUND OF THE INVENTION

Field of the Invention

The present invention concerns equipment for forming metal profiles.

Description of the Prior Art

For forming metal profiles the stretch-forming process known in itself is more precise than conventional bending alone. A precision of plus or minus 1 mm can be obtained by stretch-forming as against plus or minus 5 mm for conventional bending.

For obtaining localized deformation of a profile the hydroforming process also known in itself produces very high precision, of plus or minus 0.2 mm, and consists in enclosing the profile in a shell having appropriate cavities and directing into the profile a liquid at a high pressure that causes it to espouse the internal shapes of the shell. If the profile must additionally be bent it is necessary to carry out the bending operation beforehand, by conventional bending or by stretch-forming. Hydroforming uses a hydraulic fluid, usually oil, necessitating subsequent cleaning of the profile.

An aim of the present invention is to propose equipment for carrying out on a stretch-forming machine not only the operation of bending the profile but also a hydroforming operation, either successively or simultaneously and without necessitating subsequent cleaning of the profile.

SUMMARY OF THE INVENTION

Accordingly, the invention consists in equipment for forming metal profiles on a stretch-bending machine on which a profile to be formed is held at its ends by jaws connected to stretching rams and to means for bending it against a convex punch member fixed to a toolholder table of the machine, said equipment comprising a die member, means for pressing it against the punch member once the profile has been bent against the punch member, an elastic material mandrel adapted to be placed inside the profile and means for compressing-expanding the mandrel so that it presses the profile against internal surfaces of the punch member and of the die member closed one against the other.

In a first embodiment, the elastic material mandrel is in two separate parts in contact end-to-end when introduced into the profile, each part of the mandrel including a passage open at one end only and blind at the opposite end, the end at which the passage is open being connected to a metal insert adapted to be clamped by the jaws and to enable application of hydraulic pressure, being equipped with means for connection to hydraulic pressurizing means, the metal insert entering the corresponding end of the profile.

In a second embodiment, the means for compressing-expanding the mandrel comprise a compression piston machined to the interior profile of the profile, the piston being subjected to a thrust by any means.

One embodiment of the invention will now be described with reference to the accompanying drawings.

DETAILED DESCRIPTION OF THE PREFERRED EMBODIMENTS

Figure 1:
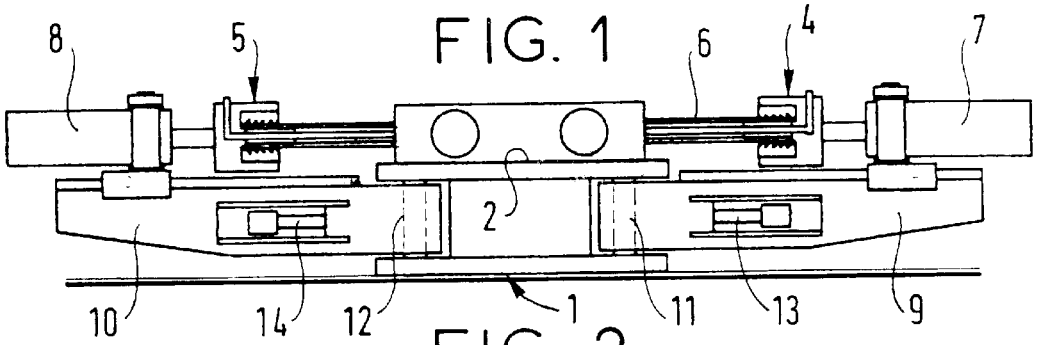
FIG. 1 is a schematic front view showing a stretch-bending machine including the equipment of the invention.
Figure 2:
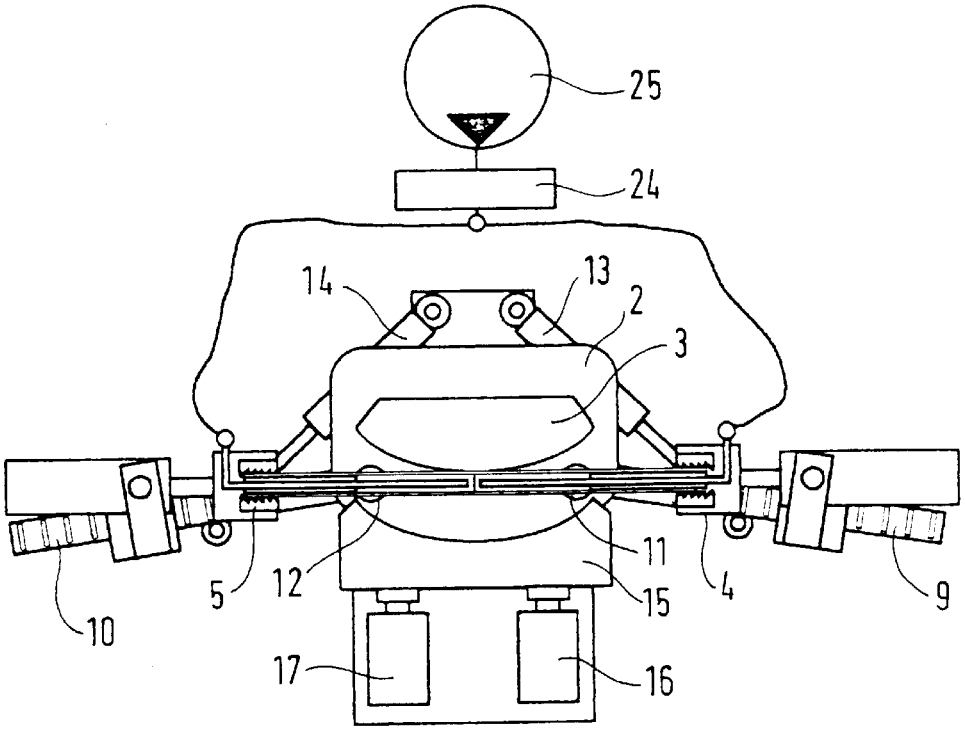
FIG. 2 is a plan view of FIG. 1.

FIGS. 1 and 2 show a machine for bending profiles. This machine conventionally includes a frame 1 comprising a toolholder table 1 onto which is fixed a punch member 3 having a convex profile corresponding to the bending to be obtained, two jaws 4, 5 for clamping the profile 6 to be bent connected to stretching rams 7, 8 for exerting a traction force on the profile 6 while it is wrapped around the punch member 3, the rams 7, 8 being in turn connected to two arms 9, 10 pivoting about axes 11, 12 connected to rams 13, 14 and serving to wrap the profile 6 against the convex punch member 3. In accordance with the invention, the machine includes equipment for effecting a hydroforming operation on the same machine, either simultaneously or not with stretching by the stretching rams 7, 8 so as to combine the expansion and elongation stresses in the material of the profile to be formed.

Figure 3:
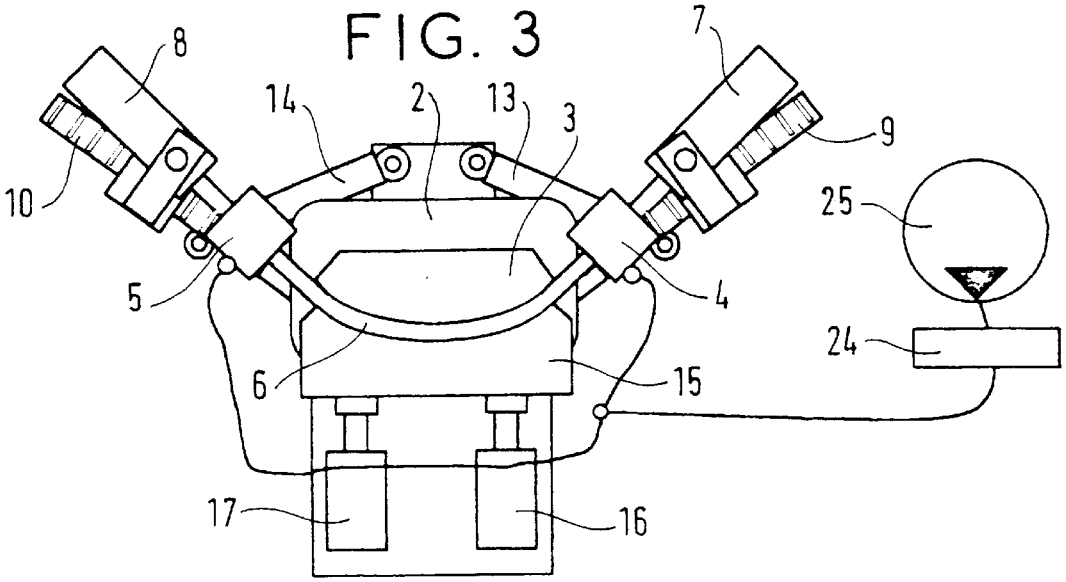
FIG. 3 is a plan view of FIG. 1 in the position in which the bending has been carried out and with the die member pressed against the punch member.

This equipment comprises a die member 15 with rams 16, 17 for pressing the die member 15 against the punch member 3 when the profile is bent against the punch member as shown in FIG. 3. Keys 18, 19 (FIGS. 6 and 7) lock the die member 15 onto the punch member 3 as shown in FIG. 7. The punch member and the die member are machined to the same profile as the profile 6. These two tools (punch member and die member) have to constitute, when in the closed position (FIGS. 3, 4, 5, 7), a passage espousing the exterior contours of the final part to be obtained, increased in the lengthwise direction by minimal additional lengths necessary for cutting and sealing the ends, and corrected to allow for the elastic recovery of the material of the profile to be formed from its shape under load to the final required shape with no external stresses.

The punch member and the die member can each be made in one or more parts. The bending punch member 3 can in particular have a contour with one or more points of inflection, rather than an exclusively convex contour. In this case, the die member 15 is of course used to cause the profile 6 to espouse the curvature of concave parts of the punch member.

The equipment further comprises an elastic material mandrel 20 seen in FIGS. 4, 5, 6, 7 and constituted of two parts 20A, 20B in the embodiment corresponding to these figures.

The mandrel 20, in two parts 20A and 20B, is introduced into the profile just before bending it and provides a support for the external part of the profile not in contact with the punch member 3 during bending.

To cause the profile 6 to espouse the internal contours of the punch member and of the die member when closed and locked together, the equipment includes means for compressing-expanding the mandrel 20.

Figure 4:
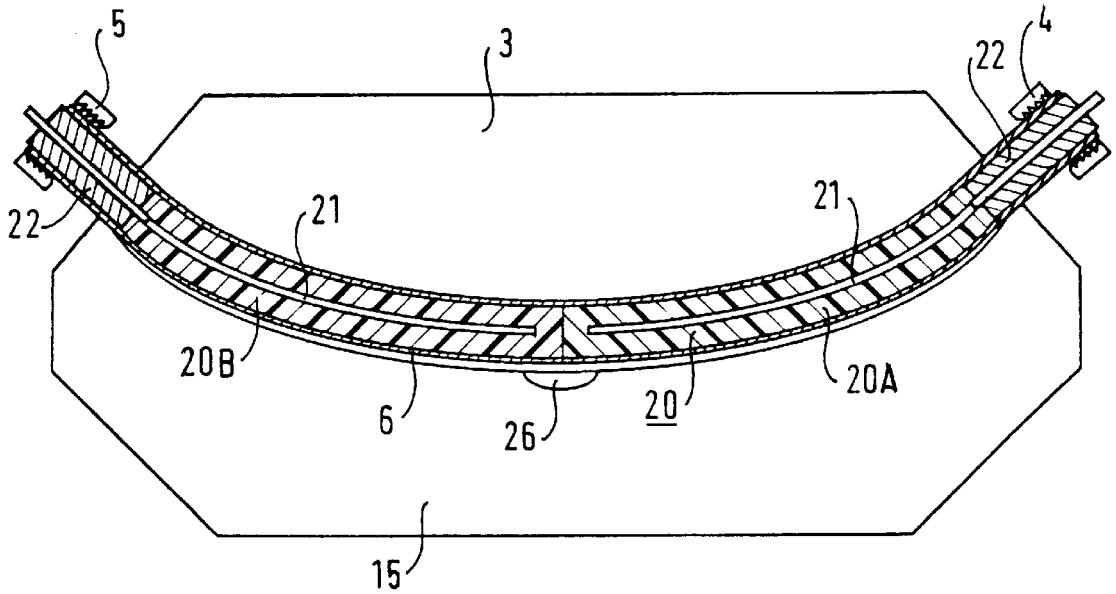
FIG. 4 is a fragmentary view to a larger scale showing the profile bent against the punch member with the die member in the position closed against the punch member.
Figure 5:
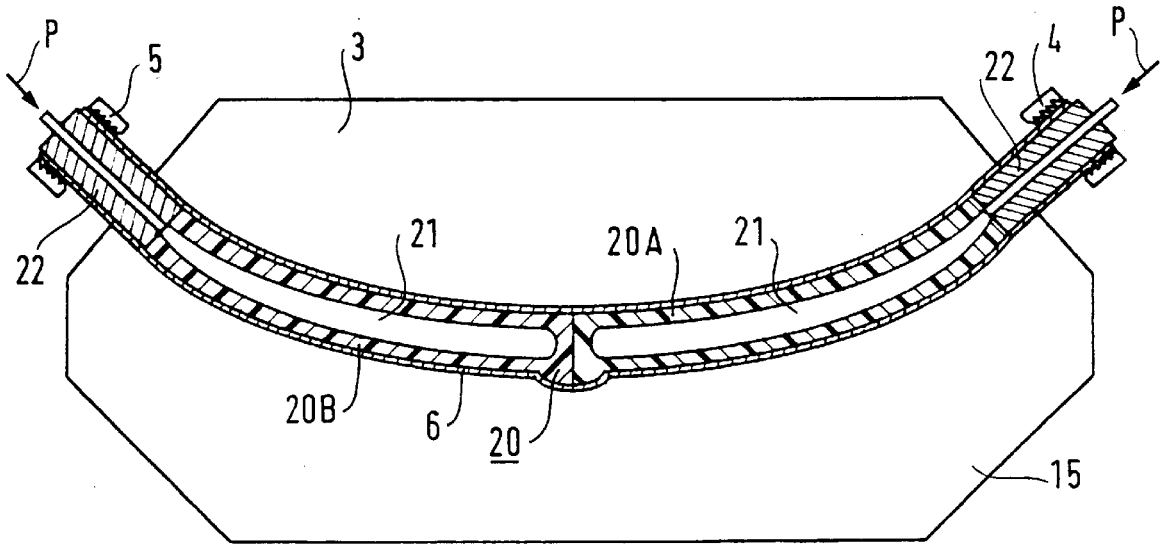
FIG. 5 is the same as FIG. 3 but when the mandrel has been compressed-expanded by means of a hydraulic fluid.
Figure 6:
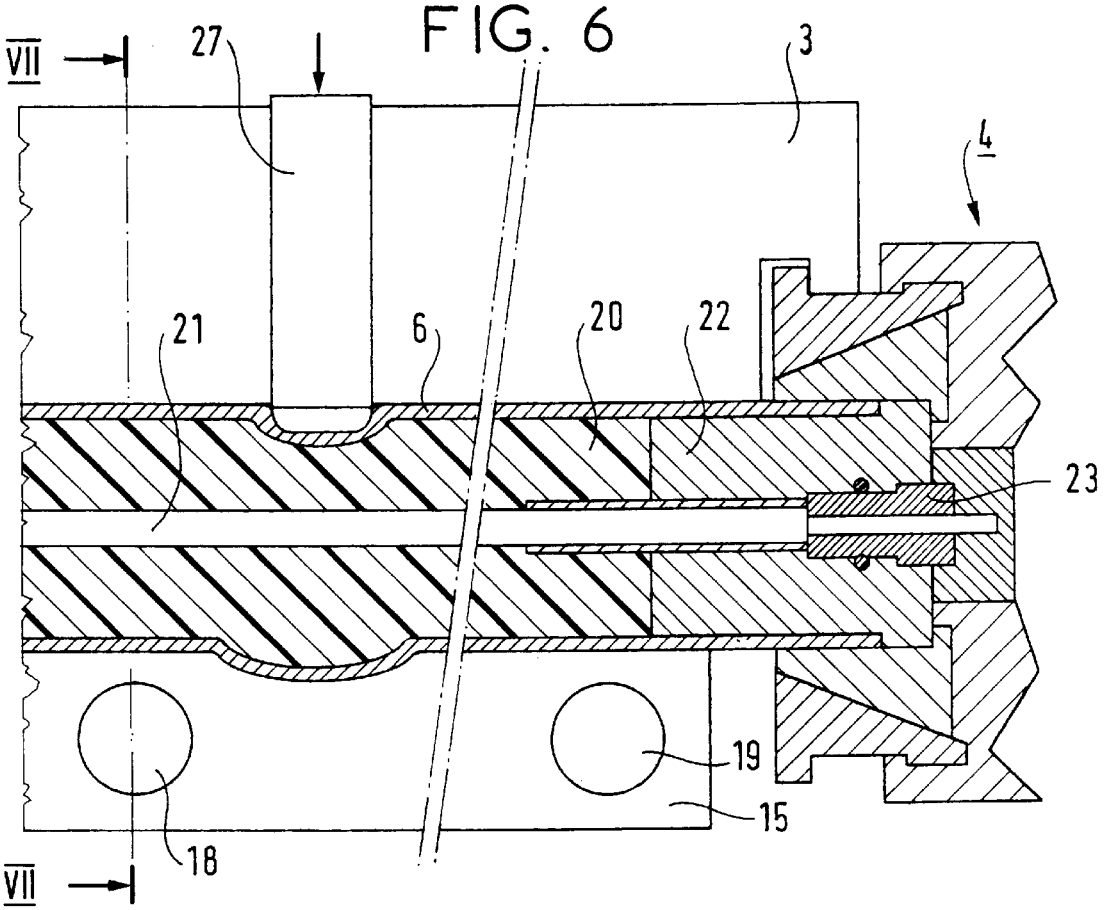
FIG. 6 is a fragmentary sectional view to a larger scale of one end of the equipment in the case of forming a closed section profile.
Figure 7:
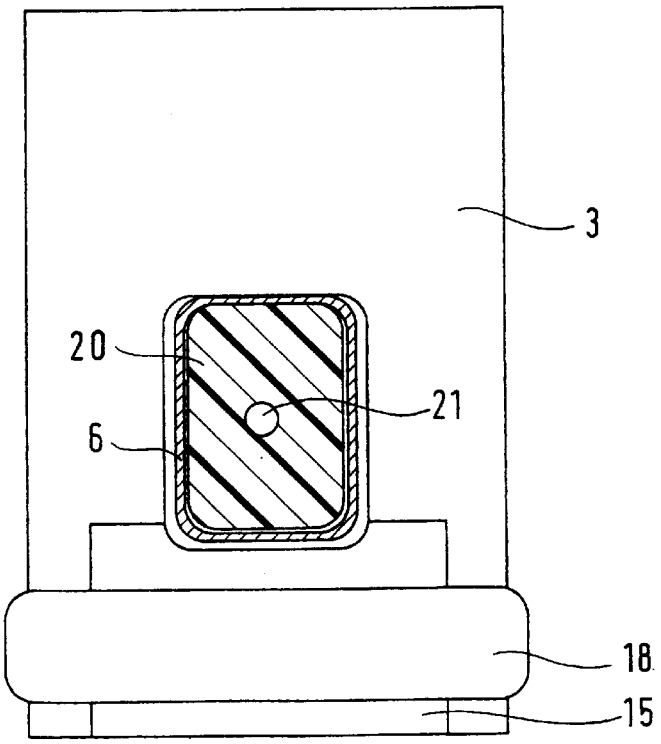
FIG. 7 is a section taken along the line VII—VII in FIG. 6.
Figure 8:
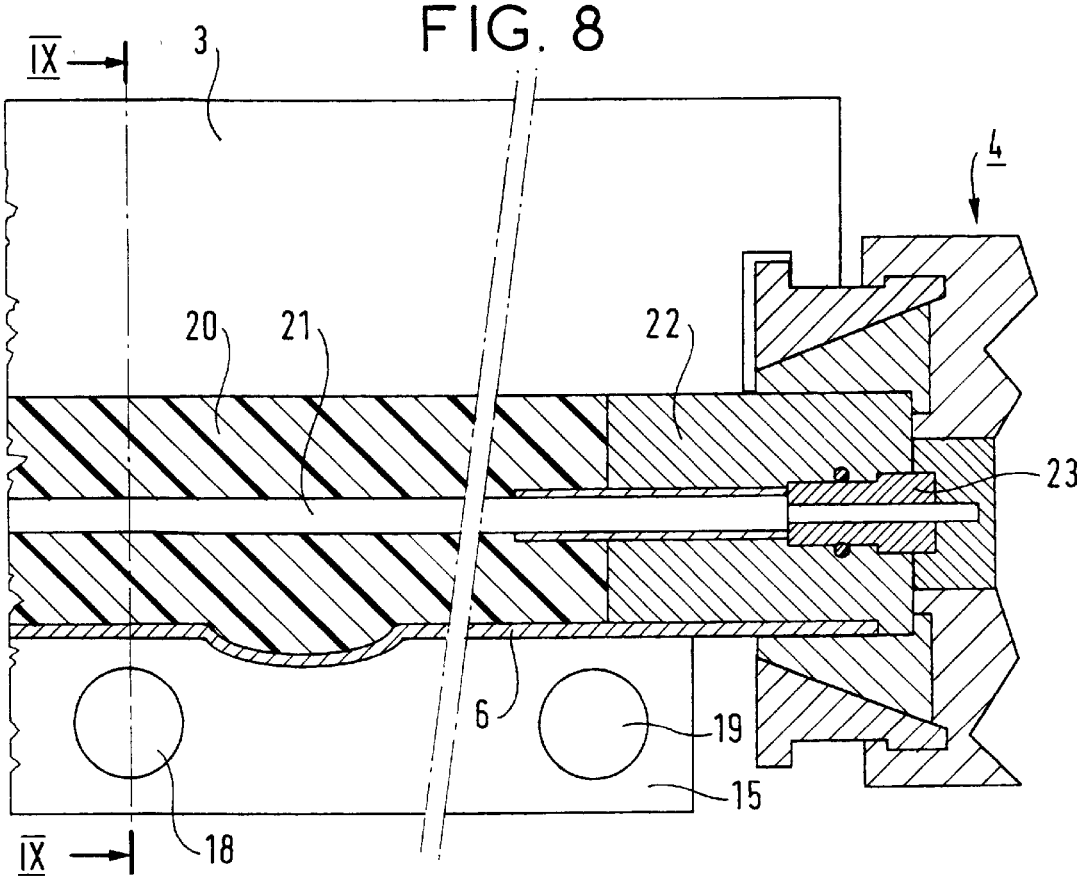
FIG. 8 is similar to FIG. 6 but in the case of forming an open section profile.
Figure 9:
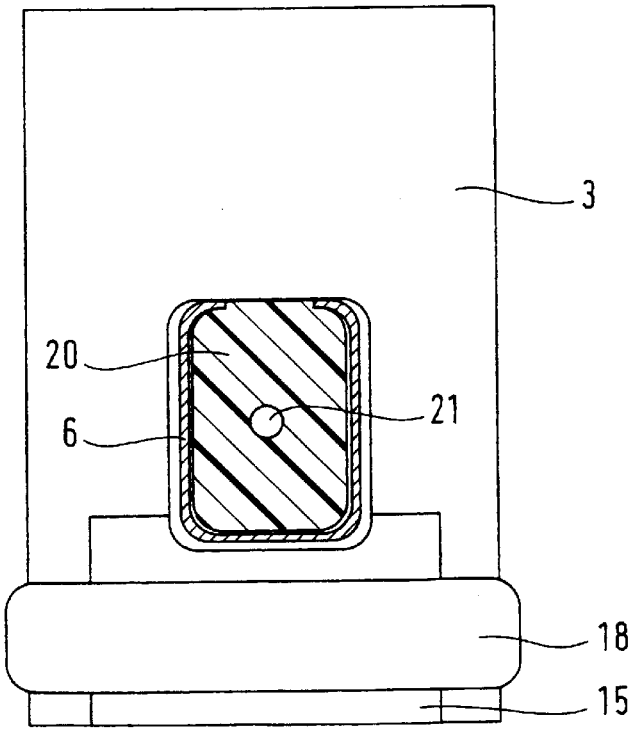
FIG. 9 is a section taken along the line XI—XI in FIG. 8.

In the embodiment corresponding to FIGS. 4 through 7 and also to FIGS. 8 and 9, hydraulic pressure is used for this. Accordingly, each part 20A (20B) of the mandrel 20 has a passage 21 in it which is blind at one end and open at the other. The end at which the passage is open is connected to a metal insert 22 that enters the corresponding end of the profile where it is clamped by the jaws 4, 5 and which has a bore through it for the hydraulic supply. As seen in FIG. 6, it is equipped with means 23 for connecting it to a hydraulic circuit comprising a regulator 24 and a hydraulic pump 25 (FIGS. 2 and 3). FIG. 4 shows a die member 15 with a recess 26. In FIG. 5 hydraulic pressure P is applied, expanding the mandrel 20 and placing the profile 6 against the surfaces of the channel formed by the punch member 3 and the die member 15 closed one against the other.

The recess 26 allowing localized deformation of the profile 6 by pressurization-expansion of the elastic material mandrel 20 could equally well be in the punch member 3. Furthermore, it could be such that said compression-expansion shears holes in or a parting line right round the circumference of the profile, for example to detach the ends held by the jaws from the central portion constituting the finished part.

FIG. 7 is a section taken along the line VII—VII in FIG. 6 before the mandrel 20 is pressurized via the passage 21 whereas in FIG. 6 the mandrel 20 is shown in the expanded state and the profile 6 is pressed against the walls of the passage.

In FIGS. 4 through 7 the profile 6 to be bent and formed has a closed section as can be seen clearly in FIG. 7.

An advantage of using the mandrel 20 to place the profile 6 against the walls of its housing in the form of a passage is that the profile does not need to be cleaned after it is formed since it is not in contact with the hydroforming liquid, the two parts 20A and 20B of the mandrel being sealed.

FIG. 6 shows that concave deformations can be made in the profile 6 by means of punches 27, the elastic mandrel 20 then serving as a pressure pad.

The passage 21 can be intentionally pressurized before, simultaneously with or after stretching via the jaws 4, 5 by means of the rams 6, 7.

FIGS. 8 and 9, respectively equivalent to FIGS. 6 and 7, show the bending and the forming of an open section profile 6.

Figure 10:
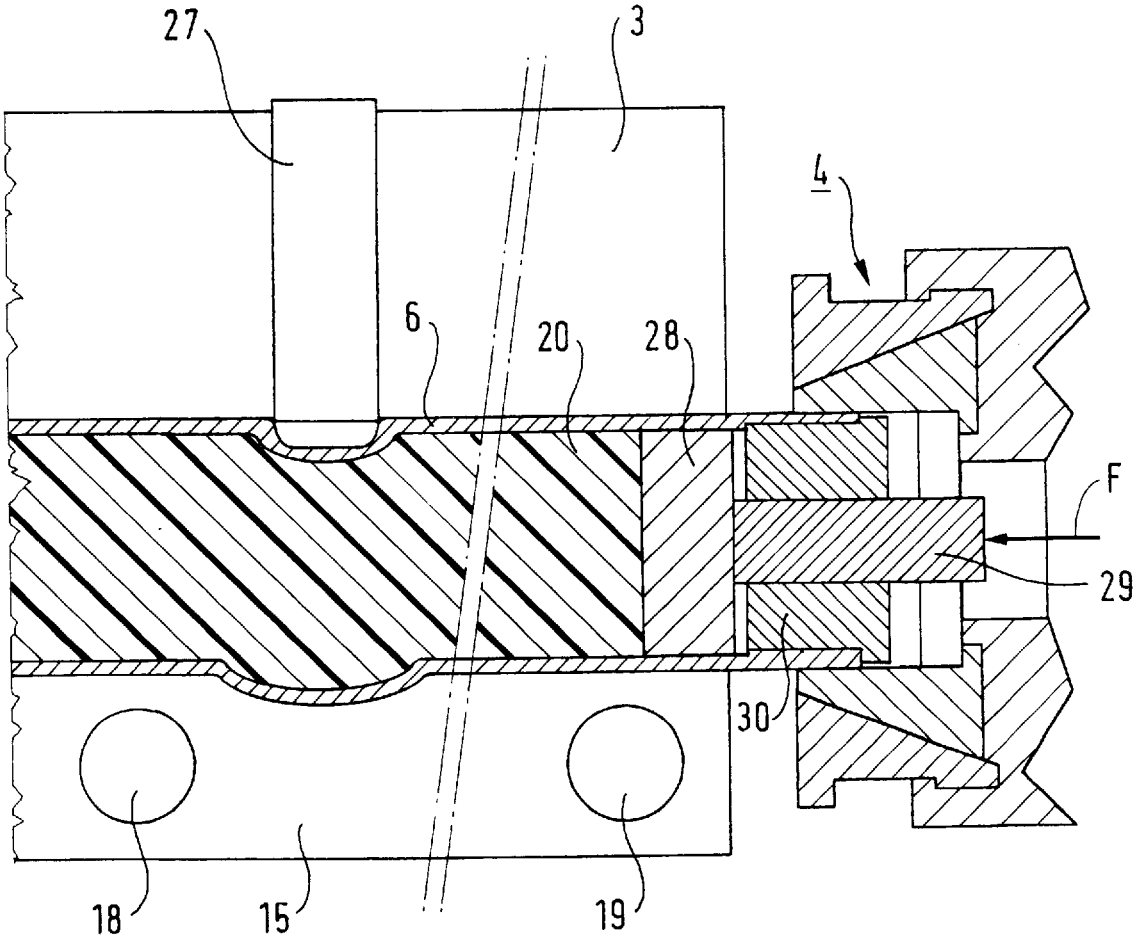
FIG. 10 is similar to FIG. 6 but in the case where the mandrel is compressed-expanded by a piston.

FIG. 10 shows a variant in which the mandrel 20 is compression-expanded not by hydraulic pressure but by means of a compression piston 28 machined to the interior profile of the profile. This piston is pressed directly against the elastic mandrel 20 and includes a tail 29 passing through a metal insert 30 which the jaws 5 clamp. Compression-expansion is assured by a thrust force F exerted on the piston 28 by any means known in itself.

This variant can be used in particular when the profile 1 to be formed is short. In this variant, the elastic mandrel 20 is in one piece. The force F may be applied at one end only, in which case the other end is closed by a solid metal insert clamped by the jaws 4, with no hole for the tail of the piston, the mandrel bearing directly against this insert.

The elastic mandrel 20 is made from an elastomer such as polyurethane, for example. Depending on the thickness of the profile, the hydraulic pressure applied can be between a few tens of bars and a few thousand bars.

There is claimed:

1. Equipment for forming metal profiles on a stretch-bending machine on which a profile to be formed is held at its ends by jaws connected to stretching rams and to means for bending it against a convex punch member fixed to a toolholder table of the machine, said equipment comprising a die member, means for pressing it against said punch member once said profile has been bent against said punch member, an elastic material mandrel adapted to be placed inside said profile and means for compressing-expanding said mandrel so that it presses said profile against internal surfaces of said punch member and of said die member when closed one against the other.

2. The equipment claimed in claim 1 wherein said elastic material mandrel is in two separate parts in contact end-to-end when introduced into said profile, each part of said mandrel including a passage open at one end only and blind at the opposite end, the end at which said passage is open being connected to a metal insert adapted to be clamped by said jaws and to enable application of hydraulic pressure, being equipped with means for connection to hydraulic pressurizing means, said metal insert entering the corresponding end of said profile.

3. The equipment claimed in claim 1 wherein said means for compressing-expanding said mandrel comprise a compression piston machined to the interior profile of said profile, said piston being subjected to a thrust by any means.

4. The equipment claimed in claim 1 wherein said die member and optionally also said punch member incorporate a recess.

* * * * *